US005704315A

United States Patent [19]

Tsuchida et al.

[11] Patent Number: 5,704,315

[45] Date of Patent: Jan. 6, 1998

[54] VALVE OPERATING SYSTEM IN SOHC-TYPE ENGINE

[75] Inventors: Koji Tsuchida; Chikara Tanaka; Jiro Takagi; Hirokazu Ohsaki, all of Wako, Japan

[73] Assignee: Honda Giken Kogyo Kabushiki Kaisha, Tokyo, Japan

[21] Appl. No.: 694,701

[22] Filed: Aug. 9, 1996

[30] Foreign Application Priority Data

Aug. 9, 1995 [JP] Japan ..... 7-203677

[51] Int. Cl.[6] ..... F01L 1/18; F01L 13/00; F01M 1/06; F01M 9/10

[52] U.S. Cl. ..... 123/90.16; 123/90.27; 123/90.33; 123/90.34; 123/90.36; 123/90.6; 123/193.5; 123/196 M

[58] Field of Search ..... 123/90.15, 90.16, 123/90.17, 90.22, 90.23, 90.27, 90.33, 90.34, 90.36, 90.39, 90.4, 90.42, 90.44, 90.6, 193.5, 193.3, 196 R, 196 M; 74/567

[56] References Cited

U.S. PATENT DOCUMENTS

| | | | |
|---|---|---|---|
| 4,537,166 | 8/1985 | Kimura et al. | 123/90.34 |
| 4,809,562 | 3/1989 | Bendoraitas et al. | 123/90.6 |
| 4,938,188 | 7/1990 | Seki et al. | 123/90.16 |
| 5,150,675 | 9/1992 | Murata | 123/90.34 |
| 5,207,193 | 5/1993 | Sugimoto et al. | 123/90.27 |
| 5,363,818 | 11/1994 | Iwata et al. | 123/90.27 |

FOREIGN PATENT DOCUMENTS 3-97507 10/1991 Japan .

*Primary Examiner*—Weilun Lo

*Attorney, Agent, or Firm*—Armstrong, Westerman, Hattori, McLeland & Naughton

[57] ABSTRACT

In an engine including a variable timing/lift mechanism for an intake valve, journal portions of a valve-operating cam shaft are supported on cam bearing portions integrally provided in a cylinder head, and an intake rocker shaft is fixed by bolts to rocker shaft fixing portions provided on an upper surface of the cam bearing portions. By bringing opposite sides of intake rocker arms swingably supported on the intake rocker shaft into slidable abutment against positioning faces integrally formed on opposite sides of the cam bearing portions, the intake rocker arms are positioned in a thrust direction. Thus, it is possible to accurately and easily position the intake rocker arms in the thrust direction without the need for a special member.

6 Claims, 10 Drawing Sheets

GIG.7

VALVE OPERATING SYSTEM IN SOHC-TYPE ENGINE

BACKGROUND OF THE INVENTION

1. Field of the Invention

The present invention relates to a valve operating system in a Single Overhead Camshaft (SOHC) type engine including means for positioning rocker arms in a thrust direction.

2. Description of the Related Art

Such a valve operating system in an SOHC type engine has been conventionally known, for example, from Japanese Utility Model Application Laid-open No. 3-97507.

The above known valve operating system in the SOHC type engine uses a spring for positioning the rocker arms.

However, when the positioning means using the conventional spring is applied to a valve operating system including a hydraulic actuator adapted to switch the connection between a plurality of intake rocker arms driven by a plurality of intake cams provided on a valve operating cam shaft, thereby controlling the timing or the lift of an intake valve, there is a possibility that the spring may be influenced by a hydraulic pressure, resulting in an insufficient thrust limitation for the rocker arms and hence, the operation of the hydraulic actuator cannot smoothly be carried out.

When a collar member or the like is used in place of the spring, the following problem is encountered: it is necessary to prepare many types of collar members having different thicknesses in order to absorb an error of assembling cam holders to the cylinder head and for this reason, not only the management of parts is troublesome, but also much labor is required for the operation of positioning the intake rocker arms.

SUMMARY OF THE INVENTION

Accordingly, it is an object of the present invention to accurately and easily position the intake rocker arms in a thrust direction without the need for special members.

To achieve the above object, according to a first aspect and feature of the present invention, there is provided a valve operating system in an SOHC type engine comprising a hydraulic actuator which switches the states of connection between a plurality of intake rocker arms driven by a plurality of intake cams provided on a valve-operating cam shaft, thereby controlling the timing or the lift of an intake valve, wherein the valve operating system includes: cam bearing portions integrally formed to a cylinder head for supporting cam journal portions having a diameter larger than that of a locus of rotation of cam lobes of the intake cams; rocker shaft fixing portions integrally extended axially of the valve-operating cam shaft from the cam bearing portions for fixing the intake rocker shafts by bolts, the plurality of intake rocker arms being disposed in proximity to one another between the adjacent rocker shaft fixing portions; and positioning faces formed at opposed regions of the adjacent rocker shaft fixing portions for positioning the intake rocker arms in a thrust direction.

With such arrangement, it is possible not only to accurately and easily position the intake rocker arms in the thrust direction without use of a special member such as a collar for absorbing an assembling error, but also to fix the intake rocker shaft in the vicinity of the intake rocker arms by the bolt. Thus, the deflection of the intake rocker shaft can be limited to smoothly perform the operation of the hydraulic actuator, thereby correctly controlling the timing and the lift of the intake valve.

According to a second aspect and feature of the present invention, in addition to the first feature, the valve operating system further includes: a first oil passage for supplying a control oil pressure into an oil passage formed in the intake rocker shaft to operate the hydraulic actuator, the first oil passage being formed at a side of the cam bearing portions on the side of an axially one end of the valve-operating cam shaft, and at a location displaced axially of the intake rocker shaft from the bolt fixing the intake rocker shaft; a control oil passage formed in a bolt bore for coupling the cylinder head to a cylinder block; the control oil passage and the first oil passage being put into communication with each other by a second oil passage having a downstream end which opens into the cam journal portion supported on the cam bearing portion.

With such arrangement, the first oil passage for supplying the control oil pressure into the oil passage in the intake rocker shaft can be easily formed without interference with the bolt for fixing the intake rocker shaft and hence, the rigidity of the cam bearing portion can also be insured. Moreover, not only the control oil passage communicating with the first oil passage can be formed utilizing a bolt bore for coupling the cylinder head to a cylinder block, but also the cam journal portions can be lubricated utilizing the second oil passage which permits communication between the control oil passage and the first oil passage.

According to a third aspect and feature of the present invention, in addition to the second feature, a pair of the cylinder heads are provided as the cylinder head, and the pair of cylinder heads are spread into a V-shape from a cylinder block, the valve-operating cam shaft in each of the cylinder heads being provided at its axially one and other ends respectively with a control oil passage for supplying the control oil pressure into the oil passage formed in the intake rocker shaft, and with a lubricating oil passage for supplying a lubricating oil for lubricating the cam journal portions into an oil passage formed in an exhaust rocker shaft, the oil passage in the intake rocker shaft being put into communication with the control oil passage by a hollow knock pin on the side of the axially one end, the communication between the oil passage in the exhaust rocker shaft and the control oil passage being blocked by the cam journal portion on the side of the axially one end, the communication between the oil passage in the intake rocker shaft and the lubricating oil passage being blocked by a solid knock pin on the side of the axially other end, and the lubricating oil passage being put into communication with the oil passage in the exhaust rocker shaft by an annular groove formed in the cam journal portion on the side of the axially other end.

With such arrangement, the required oil passages can be formed in the cylinder head only by selecting the shapes of the knock pin and the cam journal portion and thus, it is possible to use the same members for the pair of cylinder heads in the V-type engine.

According to a fourth aspect and feature of the present invention, in addition to the first feature, the hydraulic actuator comprises: a switching pin for connecting/disconnecting a driving intake rocker arm driven by a high-speed intake cam and a free intake rocker arm driven by a low-speed intake cam; a hydraulic pressure chamber which one end of the switching pin faces, and a return spring for biasing the other end of the switching pin toward the hydraulic pressure chamber; and wherein the control oil pressure is supplied into the hydraulic pressure chamber through an oil passage formed in the intake rocker shaft.

With such arrangement, it is possible to change the timing and the lift of the intake valve by a simple structure.

According to a fifth aspect and feature of the present invention, in addition to the first feature, the rocker shaft fixing portions and rollers mounted on the exhaust rocker arms to abut against the exhaust cams on the valve-operating cam shaft are disposed on a plane perpendicular to an axis of the valve-operating cam shaft.

With such arrangement, it is possible not only to reduce the dimensions of the valve operating mechanism in an axial direction of the valve-operating cam shaft, but also to effectively lubricate the rollers, because the oil repelled up by the valve-operating cam shaft collides against the rocker shaft fixing portions and as a result, it is repelled back to the rollers.

The above and other objects, features and advantages of the invention will become apparent from the following description of a preferred embodiment taken in conjunction with the accompanying drawings.

DETAILED DESCRIPTION OF THE PREFERRED EMBODIMENT

Figure 1:
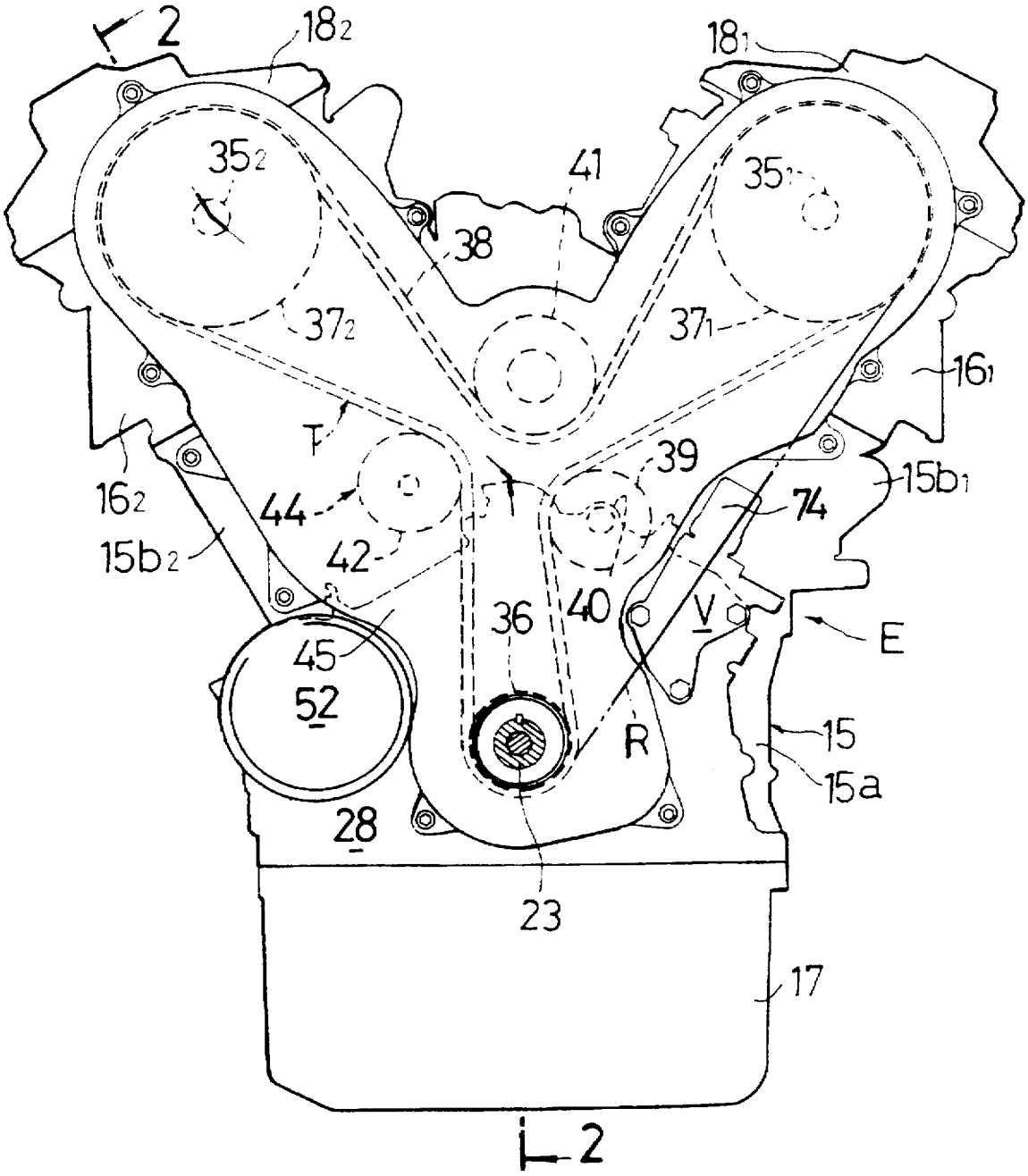
FIG. 1 is a side view of a portion of an engine on the side of a timing belt.
Figure 2:
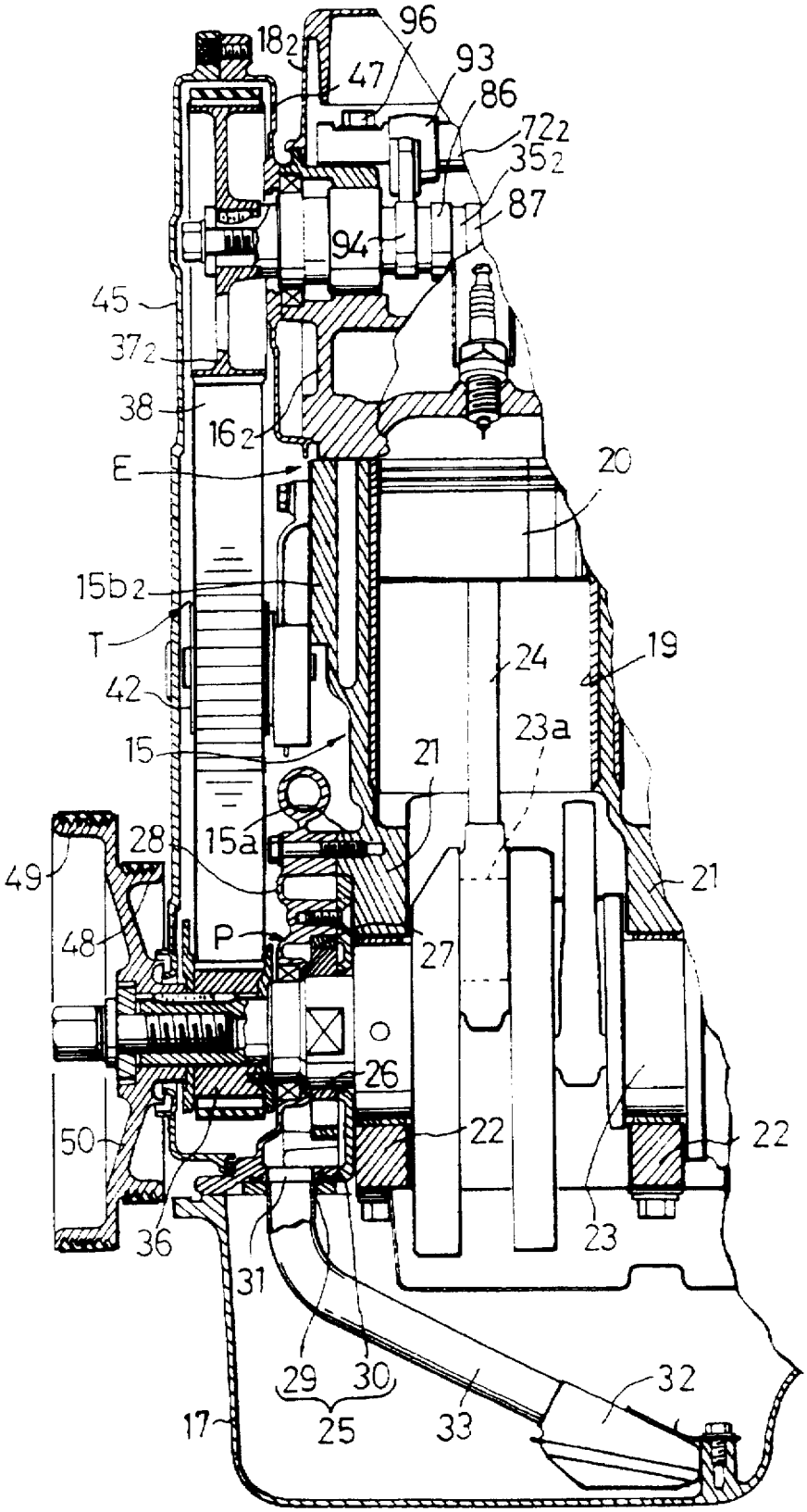
FIG. 2 is a sectional view taken along the line 2—2 in FIG. 1.

Referring first to FIGS. 1 and 2, an engine body E is constituted of a pair of cylinder heads $16_1$ and $16_2$ coupled to an upper portion of a cylinder block 15 which is formed into a V-shape. An oil pan 17 is coupled to a lower portion of the cylinder block 15, and head covers $18_1$ and $18_2$ are coupled to upper portions of the cylinder heads $16_1$ and $16_2$ respectively.

The cylinder block 15 includes a crankcase portion 15*a*, and a pair of cylinder barrel portions $15b_1$ and $15b_2$ extending upwardly from the crankcase portion 15*a* to form a V-shape. The cylinder heads $16_1$ and $16_2$ are coupled to upper portions of the cylinder barrel portions $15b_1$ and $15b_2$. The cylinder barrel portions $15b_1$ and $15b_2$ are provided with a plurality of cylinder bores 19 arranged in series, and pistons 20 are slidably received in the cylinder bores 19, respectively. A plurality of journal bearings 21 are mounted in the crankcase portion 15*a* at distances in a direction of arrangement of cylinder bores 19. A crankshaft 23 is rotatably carried by bearing caps 22 secured respectively to lower surfaces of the journal bearings 21 and by the journal bearings 21. Crankpins 23*a* of the crankshaft 23 are connected to the pistons 20 through connecting rods 24.

An oil pump P driven by the crankshaft 23 is disposed on an outer surface of one side wall of the cylinder block 15 adjacent one axial end of the crankshaft 23. The oil pump P is a trochoidal pump which includes an inner rotor 26 fixed to the crankshaft 23 and an outer rotor 27 meshed with the inner rotor 26. The inner and outer rotors 26 and 27 are rotatably accommodated and disposed at mutually eccentrically displaced locations within a pump case 25 mounted to the outer surface of the side wall of the cylinder block 15.

A pump body 28 is fastened to the outer surface of the side wall of the cylinder block 15. The pump case 25 is composed of a pump case portion 29 provided behind the pump body 28, and a case member 30 coupled to the pump case portion 29. In a state in which the case member 30 has been mounted behind the pump case portion 29, i.e., on the side of the cylinder block 15, the pump body 28 is coupled to the cylinder block 15.

An oil strainer 32 is disposed within the oil pan 17 and connected through a suction pipe to a suction opening provided in the pump case 25.

A wrapping connector system T is disposed at a location proximate to an outer surface of one side wall of the engine body E for driving valve-operating cam shafts $35_1$ and $35_2$ which are rotatably carried respectively in the cylinder heads $16_1$ and $16_2$ in parallel to the crankshaft 23. The wrapping connector system T includes a first driving pulley 36 which is fixed to an end of the crankshaft 23 protruding from the pump case 25 of the oil pump P, driven pulleys $37_1$ and $37_2$ fixed to ends of the valve-operating cam shafts $35_1$ and $35_2$, respectively, and an endless timing belt 38 which is wrapped around the first driving pulley 36 and the driven pulleys $37_1$ and $37_2$. The first driving pulley 36 is fixed to the crankshaft 23 at a location in which the pump case 25 is sandwiched between the driving pulley 36 and the surface of the side wall of the cylinder block 15.

In the wrapping connector system T, an idle pulley 39 is engaged with an outer periphery of the timing belt 38 between the first driving pulley 36 and the driven pulley $37_1$. This engagement of the idle pulley 39 offsets the travel path of the timing belt 38, inwardly from a phantom path R (see FIG. 1) defined when the first driving pulley 36 and the driven pulley $37_1$ are temporarily connected directly to each other, i.e., in a direction to increase the amount of timing belt 38 wrapped around the first driving pulley 36 and the driven pulley $37_1$. The pump body 28 is provided with a boss 40 for rotatably carrying the idle pulley 39.

The timing belt 38 is wrapped around a water pump 41 between both the driven pulleys $37_1$ and $37_2$. A rotatable wheel 42 is mounted to engage the outer periphery of the timing belt 38 between the driven pulley $37_2$ and the first driving pulley 36. The rotatable wheel 42 constitutes a tensioner 44 along with a tension spring (not shown) for exhibiting a spring force in a direction to bring the rotatable wheel 42 into pressure contact with the timing belt 38.

Such wrapping connector system T is covered with a cover 45, and a rear cover 47 is disposed between the cover 45 and the cylinder heads $16_1$ and $16_2$ and coupled to an upper portion of the cover 45.

The crankshaft 23 further protrudes from the cover 45. A rotatable wheel 50 is secured to an end of the crankshaft 23 protruding from the cover 45, and has a second driving pulley 48 for driving, for example, a power-steering hydraulic pump (not shown), and a third driving pulley 49 for driving, for example, a compressor for an AC generator and an air conditioner (not shown).

Figure 11:
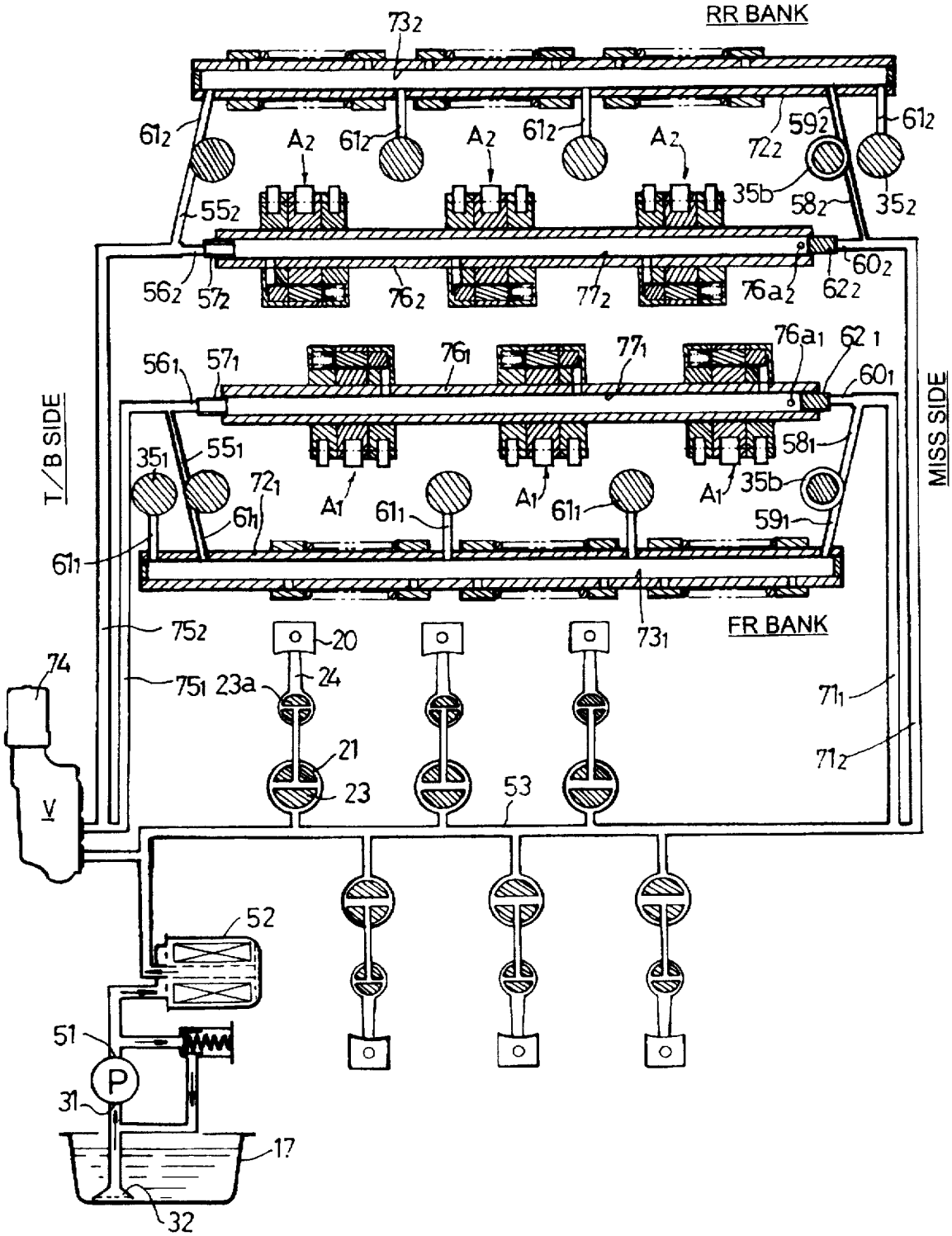
FIG. 11 is a hydraulic circuit diagram.

The outline of a hydraulic circuit will be described below with reference to FIG. 11.

A discharge port 51 of the oil pump P for pumping an oil in the oil pan 17 through the suction opening 31 is connected to a main gallery 53 through a filter/cooler unit 52, so that the oil as a lubricating oil is diverted from the main gallery 53 to lubricate the journal bearings 21 and the crank pins 23*a* of the crankshaft 23. Further, in a portion of the engine body E on the side of a transmission, the main gallery 53 is bifurcated at its terminal end into a pair of lubricating-oil passages $71_1$ and $71_2$. One of the lubricating-oil passages $71_1$ is used to lubricate the valve-operating cam shaft $35_1$ through an oil passage formed in an exhaust rocker shaft $72_1$ in a front bank, and the other lubricating-oil passage $71_2$ is used to lubricate the valve-operating cam shaft $35_2$ through an oil passage 73 formed in an exhaust rocker shaft in a rear bank.

In a portion of the engine body on the side of the timing belt, a portion of the oil passing through the filter/cooler unit 52 serves as a control oil which is controlled in pressure in an oil-pressure control valve V operated by a solenoid valve 74 and then diverted into a pair of control oil passages $75_1$ and $75_2$. The control oil is supplied from one of the control oil passages $75_1$ into an oil passage $77_1$ formed in an intake rocker shaft $76_1$ in the front bank to operate three hydraulic actuators $A_1$ for controlling the timing/lift of intake valves in the front bank. The control oil supplied from the other control oil passage $75_2$ into an oil passage $77_2$ formed in an intake rocker shaft $76_2$ in the rear bank operates three hydraulic actuators $A_2$ for controlling the timing/lift of intake valves in the rear bank.

The structure of a valve-operating mechanism will be described below by example of the rear bank with reference to FIGS. 3 to 6.

A pair of intake valves 81 and a pair of exhaust valves 82 are provided in the cylinder head $16_2$ in correspondence to each of cylinders. The intake valves 81 are operatively connected to a pair of driving intake rocker arms 83 and 84, respectively. The driving intake rocker arms 83 and 84 and a free intake rocker arm 85 interposed between the driving intake rocker arms 83 and 84 are swingably carried on a stationary intake rocker shaft $76_2$. Both the driving intake rocker arms 83 and 84 are swung by a pair of low-speed intake cams 86 provided on the valve-operating cam shaft $35_2$, and the free intake rocker arm 85 is swung by a high-speed intake cam 87 provided on the valve-operating cam shaft $35_2$.

The hydraulic actuator $A_2$ includes a first switching pin 89 which is slidably fitted into one of the driving intake rocker arms 83 to define a hydraulic pressure chamber 88 between the first switching pin 89 and the driving intake rocker arm 83, so that the first switching pin 89 can be fitted into the free intake rocker arm 85, a second switching pin 90 which is slidably fitted into the free intake rocker arm 85 with one end face abutting against the opposite end face of the first switching pin 89 from the hydraulic pressure chamber 88, so that it can be fitted into the other driving intake rocker arm 84, a limiting pin 91 slidably fitted into the other driving intake rocker arm 84 to abut against the other end face of the second switching pin 90, and a return spring 92 mounted under compression between the driving intake rocker arm 84 and the limiting pin 91 to exhibit a spring force for biasing the limiting pin 91 abutting against the first switching pin 89 through the second switching pin 90 toward the hydraulic pressure chamber 88.

The exhaust valves 82 are operatively connected to a pair of exhaust rocker arms 93, respectively. The exhaust rocker arms 93 are swung by a pair of exhaust cams 94 provided on the valve-operating cam shaft $35_2$.

The cylinder head $16_2$ is integrally formed with four cam bearing portions 16*a* for supporting the four cam journal portions 35*a* formed on the valve-operating cam shaft $35_2$. As can be seen from FIG. 5, the inside diameter of the cam journal portion $35_2$ is larger than the maximum outside diameter of the cams 86, 86, 87, 94 and 94, so that the valve-operating cam shaft $35_2$ can be inserted into and carried in the cam bearing portion 16*a* and hence, no bearing cap is mounted on the cam bearing portion 16*a*. Therefore, the accuracy of thrust limitation cannot be lowered due to an error of assembling of the bearing cap.

In the hydraulic actuator $A_2$, an increase in hydraulic pressure in the hydraulic pressure chamber 88 causes the first switching pin 89 to be fitted into the free intake rocker arm 85, while causing the second switching pin 90 to be fitted into the other driving intake rocker arm 84, whereby the rocker arms 83, 84 and 85 are connected together. When the rocker arms 83, 84 and 85 have been connected together in this manner, the driving intake rocker arms 83 and 84 are swung in unison with the free intake rocker arm 85 swung by the high-speed intake cam 87, so that the intake valves 81 are opened and closed with a timing and a lift dependent upon the high-speed intake cam 87. When the hydraulic pressure in the hydraulic pressure chamber 88 is reduced, the spring force of the return spring 92 causes the first switching pin 89 to be returned to a position where its face abutting against the second switching pin 90 corresponds to between the driving intake rocker arm 83 and the free intake rocker arm 84, while causing the second switching pin 90 to be returned to a position where its face abutting against the limiting pin 91 corresponds to between the free intake rocker arm 85 and the driving intake rocker arm 84, thus releasing the connection of the rocker arms 83, 84 and 85. In this disconnected state, the driving intake rocker arms 83 and 84 are swung by the low-speed intake cams 86, so that the intake valves 81 are opened and closed with a timing and a lift dependent upon the low-speed intake cams 86.

Even in the front bank, the intake valves 81 are operatively connected to a pair of driving intake rocker arms 83 and 84 swung by low-speed cams 86, respectively, and the driving intake rocker arms 83 and 84 and a free intake rocker arm 85 interposed between the driving intake rocker arms 83 and 84 and swung by a high-speed intake cam 87 are swingably carried on a stationary intake rocker shaft $76_1$, as in the above-described rear bank. A hydraulic actuator $A_1$ provided in the rocker arms 83, 84 and 85 is constructed in the same manner as is the hydraulic actuator $A_2$.

Figure 3:
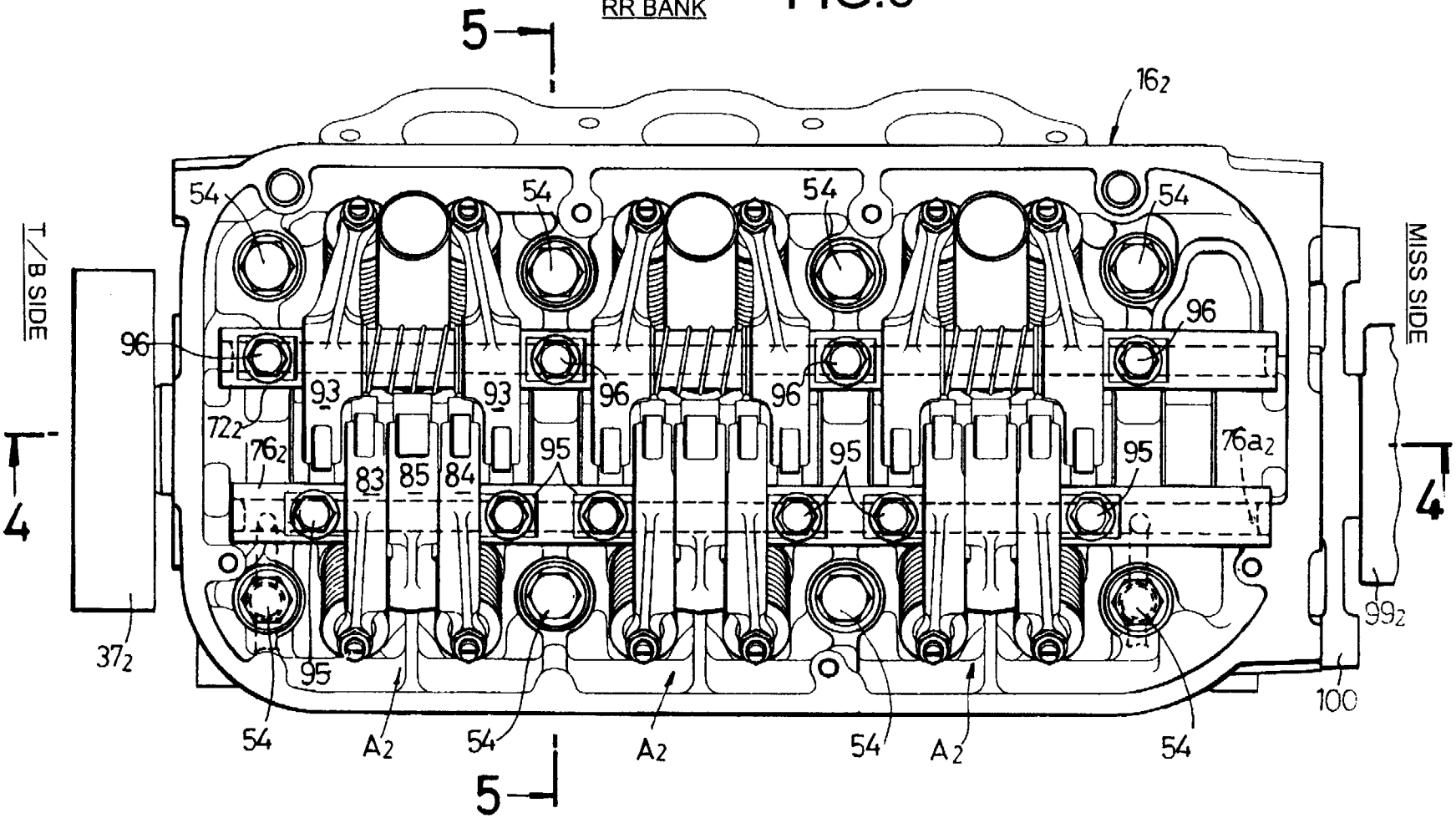
FIG. 3 is a plan view of a valve operating device in a rear bank.
Figure 4:
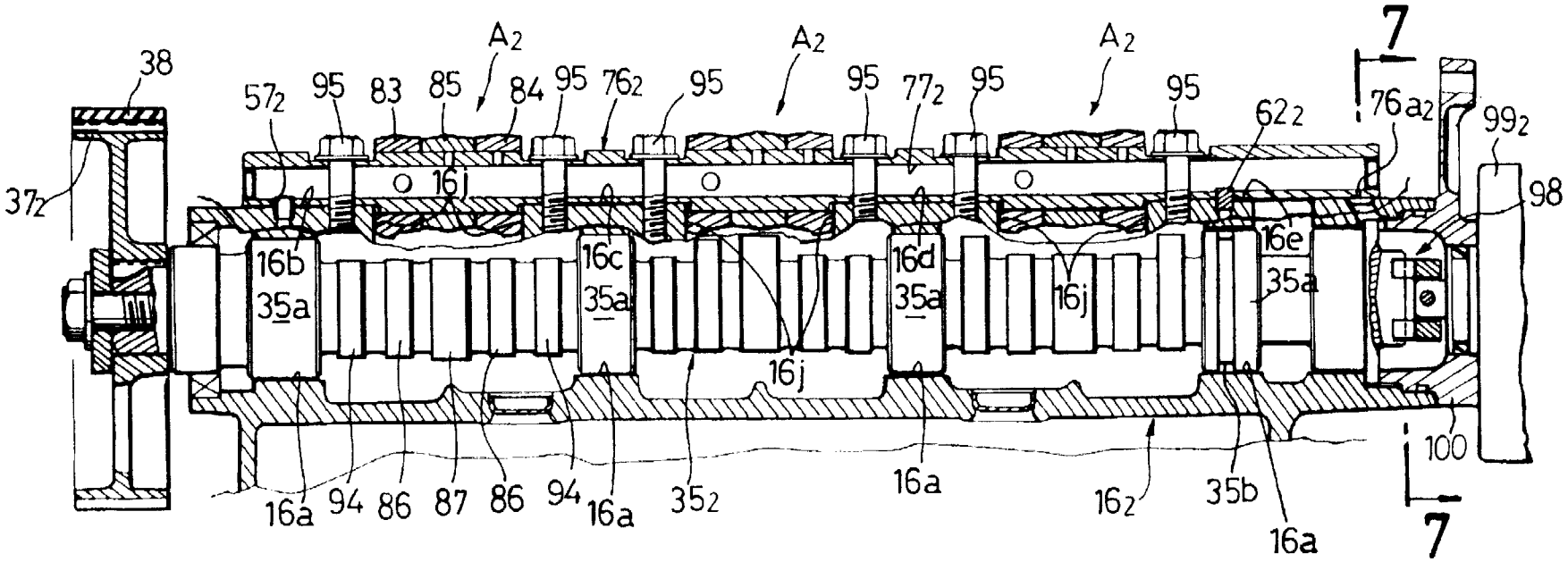
FIG. 4 is a sectional view taken along the line 4—4 in FIG. 3.
Figure 10:
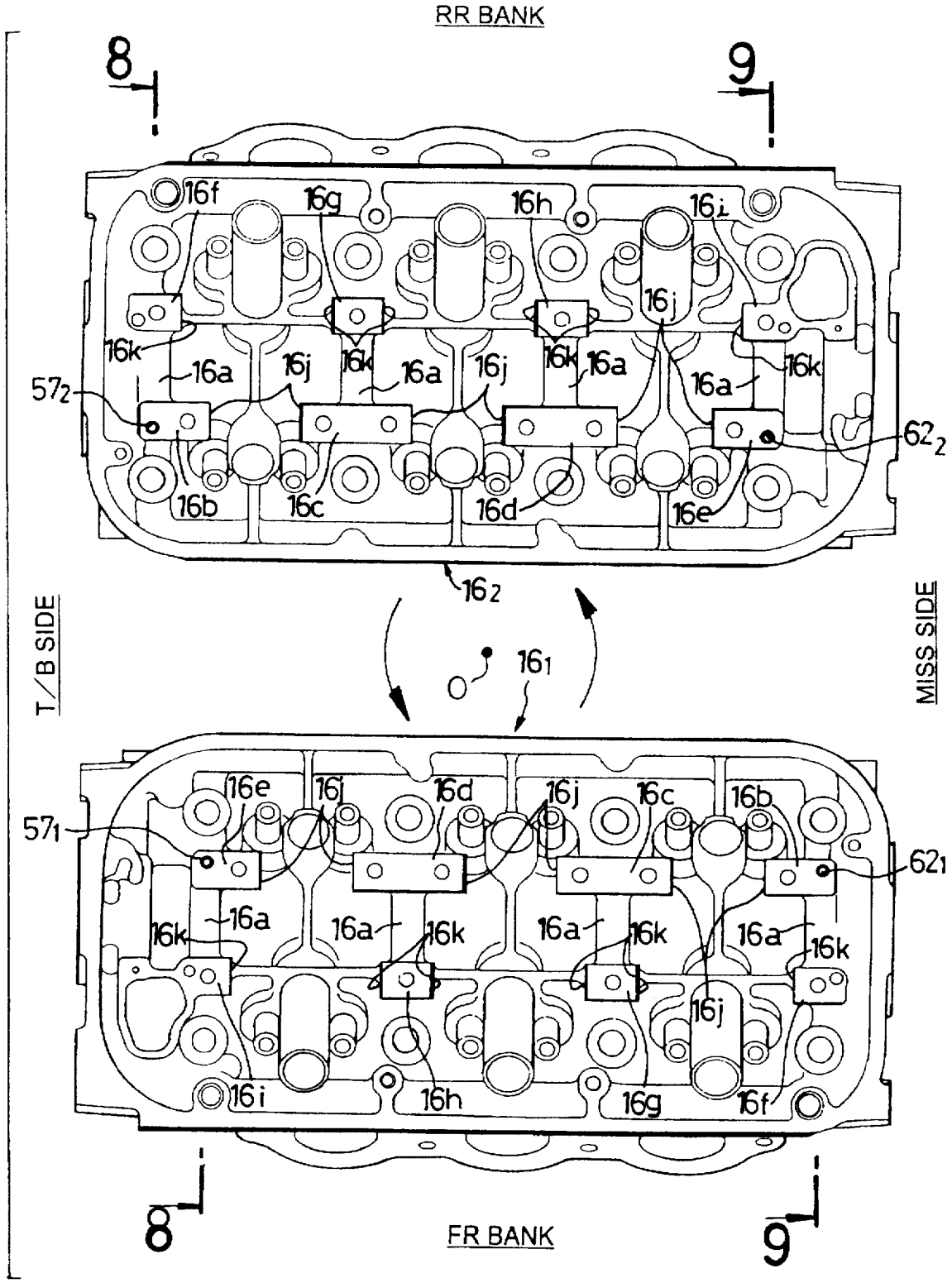
FIG. 10 is a plan view of cylinder heads.

As can be seen from FIGS. 3, 4 and 10, four intake rocker shaft fixing portions 16*b*, 16*c*, 16*d* and 16*e* for supporting the intake rocker shafts $76_1$ and $76_2$ are integrally connected on one side of five cam bearing portions 16*a* provided to support the valve-operating cam shafts $35_1$ and $35_2$ in the cylinder heads $16_1$ and $16_2$. The intake rocker shafts $76_1$ and $76_2$ are fixed to the two axially outer intake rocker shaft fixing portions 16*b* and 16*e* respectively by a single bolt 95 and also to the two axially inner intake rocker shaft fixing portions 16*c* and 16*d* respectively by two bolts 95.

Four exhaust rocker shaft fixing portions 16*f*, 16*g*, 16*h* and 16*i* for supporting the exhaust rocker shafts $72_1$ and $72_2$ are integrally connected on the other side of the cam bearing portions 16*a*. The exhaust rocker shafts $72_2$ and $72_2$ are fixed to the exhaust rocker shaft fixing portions 16*f*, 16*g*, 16*h* and 16*i* respectively by a single bolt 96.

By fixing the intake rocker shafts $76_1$ and $76_2$ to the intake rocker shaft fixing portions 16*b* to 16*e* by the bolts 95, the support rigidity can be enhanced, and by fixing the exhaust rocker shafts $72_1$ and $72_2$ to the exhaust rocker shaft fixing portions 16f to 16l by the bolts 96, the support rigidity can be enhanced.

Figure 5:
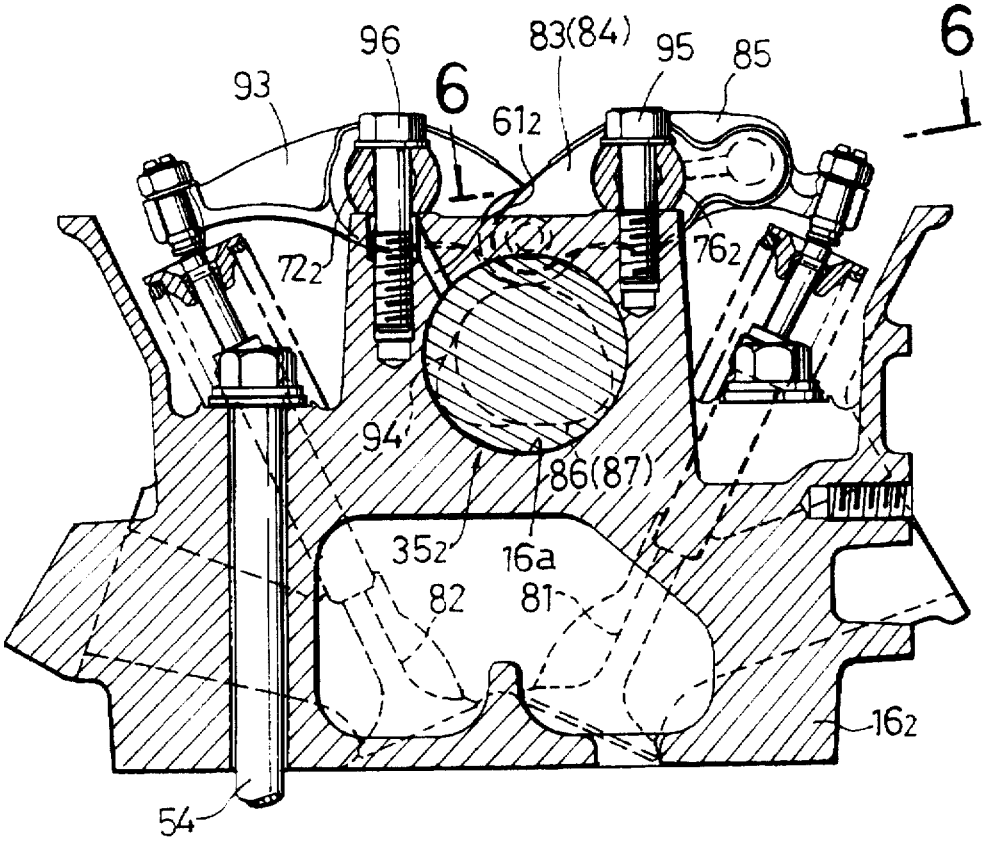
FIG. 5 is a sectional view taken along the line 5—5 in FIG. 3.
Figure 6:
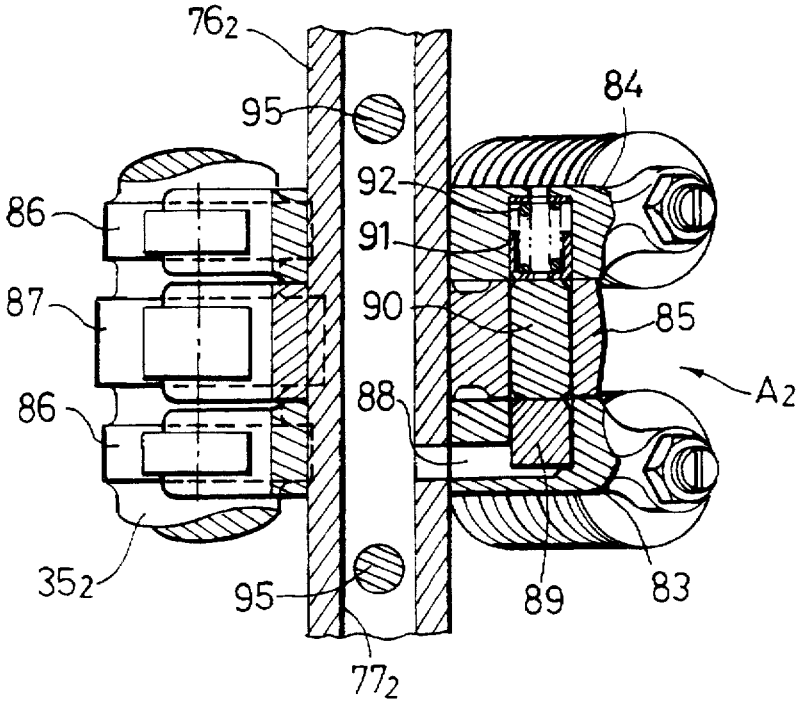
FIG. 6 is a sectional view taken along the line 6—6 in FIG. 5.

As can be seen from FIGS. 3, 5 and 10, rollers are mounted at inner ends of the exhaust rocker arms 93 to abut against the exhaust cams 94 of the valve-operating cain shafts $35_1$ and $35_2$ and disposed at locations opposed to side walls of the intake rocker shaft fixing portions 16b to 16e. In other words, the side walls of the intake rocker shaft fixing portions 16b to 16e and the exhaust rocker arms 93 are disposed in a plane perpendicular to axes of the valve-operating cam shafts $35_1$ and $35_2$, thereby reducing the axial dimension of the valve operating mechanism. Moreover, if the oil is scattered by a centrifugal force caused by the rotation of the valve-operating cam shafts $35_1$ and $35_2$, the oil is repelled to those side walls of the intake rocker shaft fixing portions 16b to 16e which face radially outwardly and as a result, the oil is deposited onto the rollers mounted on the exhaust rocker arms 93. Thus, it is possible to effectively lubricate the abutments of the roller against the exhaust cams 94 and to smoothly rotate the rollers.

As shown in FIG. 10, intake rocker arm positioning surfaces or faces 16j are integrally connected to axial ends of the intake rocker shaft fixing portions 16b to 16e, and outer sides of the driving intake rocker arms 83 and 84, i.e., sides which are not in contact with the free intake rocker arms 85, slidably abut against the intake rocker arm positioning faces 16j. By guiding the sides of the driving intake rocker arms 83 and 84 onto the rocker arm positioning faces 16j formed integrally with the intake rocker shaft fixing portions 16b to 16e in this manner, the positioning of the driving intake rocker arms 83 and 84 and the free intake rocker arm in a thrust direction can be performed easily and accurately without use of a special positioning member such as a collar or the like. As a result, the operation of the actuators $A_1$ and $A_2$ governing the connection and disconnection between the driving intake rocker arms 83 and 84 and the free intake rocker arm 85 can smoothly be performed.

Also, exhaust rocker arm positioning surfaces or faces 16k are integrally connected to axial ends of the exhaust rocker shaft fixing portions 16f to 16i. The two exhaust rocker arms 93 forming a pair are biased away from each other by springs 97, so that their sides not in contact with the springs 97 slidably abut against the exhaust rocker arm positioning faces 16k. By guiding the sides of the exhaust rocker arms 93 onto the exhaust rocker arm positioning faces 16k formed integrally with the exhaust rocker shaft fixing portions 16f to 16i in this manner, the positioning of the exhaust rocker arms 93 in a thrust direction can be easily performed.

The structure of a control oil passage extending via the intake rocker shafts $76_1$ and $76_2$ to the hydraulic actuators $A_1$ and $A_2$ and the structure of a lubricating oil passage extending via the exhaust rocker shafts $72_1$ and $72_2$ to the valve-operating cam shafts $35_1$ and $35_2$ will be described below primarily with reference to FIGS. 8 to 11.

The main gallery 53 supplied with the oil as a lubricating oil from the oil pump P is formed axially of the crankshaft 23 in the vicinity of a junction between the front and rear banks in the engine body E. In the portion of the engine body E on the side of the timing belt, the control oil supplied from the hydraulic pressure control valve V is diverted into the control oil passage $75_1$ formed in the front bank and the control oil passage $75_2$ formed in the rear bank. Each of the control oil passages $75_1$ and $75_2$ is comprised of a first control oil passage section $75a_1$, $75a_2$ provided in the cylinder barrel portion $15b_1$, $15b_2$, and a second control oil passage section $75b_1$, $75b_2$ formed along the outer periphery of a bolt 54 for coupling the cylinder head $16_1$, $16_2$ to the cylinder barrel portion $15b_1$, $15b_2$, respectively.

Downstream ends of second oil passage sections $55_1$ and $55_2$ diverging perpendicularly from the second control oil passage sections $75b_1$ and $75b_2$ communicate with the cam journal portions 35a of the valve-operating cam shafts $35_1$ and $35_2$ (the cam journal portion 35a second from the timing belt side in the front bank and the cam journal portion 35a nearest to the timing belt in the rear bank), thereby ensuring the lubrication of such cam journal portions 35a.

In the front bank, the intake rocker shaft $76_1$ is located at the intake rocker shaft fixing portion 16e by a hollow knock pin $57_1$, and a downstream end of a first oil passage $56_1$ diverging in a perpendicular direction from an intermediate portion of the second oil passage $55_1$ communicates with the oil passage $77_1$ in the intake rocker shaft through the hollow knock pin $57_1$. In the rear bank, the intake rocker shaft $76_1$ is located at the intake rocker shaft fixing portion 16b by a hollow knock pin $57_2$, and a downstream end of a first oil passage $56_2$ diverging in a perpendicular direction from an intermediate portion of the second oil passage $55_1$ communicates with the oil passage $77_2$ in the intake rocker shaft through the hollow knock pin $57_2$. Downstream ends (ends on the side of the transmission) of the intake rocker shafts $76_1$ and $76_2$ are closed by solid knock pins $62_1$ and $62_2$ which will be described hereinafter.

Thus, the control oil from the hydraulic pressure control valve V is supplied to the oil passages $77_1$ and $77_2$ in the intake rocker shafts through the control oil passages $71_1$ and $71_2$, the second oil passages $55_1$ and $55_2$ and the first oil passages $56_1$ and $56_2$, thereby operating the hydraulic actuators $A_1$ and $A_2$.

In the portion of the engine body E on the side of the transmission, the main gallery 53 is bifurcated at its downstream end into the lubricating oil passage $71_1$ in the front bank and the lubricating oil passage $71_2$ in the rear bank. Each of the lubricating oil passages $71_1$ and $71_2$ is comprised of a first lubricating oil passage section $71a_1$, $71a_2$ provided in the cylinder barrel portion $15b_1$, $15b_2$ of the cylinder block 15, and a second lubricating oil passage section $71b_1$, $71b_2$ formed along the outer periphery of the bolt 54 coupling the cylinder $16_1$, $16_2$ to the cylinder barrel portion $15b_1$, $15b_2$, respectively.

Downstream ends of third oil passage sections $58_1$ and $58_2$ diverging perpendicularly from the second lubricating oil passage sections $71b_1$ and $71b_2$ communicate with the cam journal portions 35a of the valve-operating cam shafts $35_1$ and $35_2$ (the cam journal portion 35a nearest to the timing belt side in the front bank and the cam journal portion 35a second from the timing belt side in the rear bank), thereby ensuring the lubrication of such cam journal portions 35a. Further, fourth oil passages $59_1$ and $59_2$ extending from the annular grooves 35b communicate with the oil passages $73_1$ and $73_2$ in the exhaust rocker shafts, respectively.

In the front bank, the intake rocker shaft $76_1$ is located at the intake rocker shaft fixing portion 16b by the solid knock pin $62_1$, and a downstream end of a fifth oil passage $60_1$ diverging perpendicularly from an intermediate portion of the third oil passage $58_1$ is closed by the solid knock pin $62_1$ and inhibited from communicating with the oil passage $77_1$ in the intake rocker shaft. In the rear bank, the intake rocker shaft $76_2$ is located at the intake rocker shaft fixing portion 16e by the solid knock pin $62_2$, and a downstream end of a fifth oil passage $60_2$ diverging perpendicularly from an intermediate portion of the third oil passage $58_2$ is closed by the solid knock pin $62_2$ and inhibited from communicating with the oil passage $77_2$ in the intake rocker shaft.

Thus, the lubricating oil supplied into each of the oil passages $73_1$ and $73_2$ in the exhaust rocker shafts lubricates each of the cam journal portions 35a of the valve-operating shafts $35_1$ and $35_2$ through four sixth oil passages $61_1$, $61_2$ diverging from each of the oil passages $73_1$ and $73_2$ in the exhaust rocker shafts. As can be seen from FIG. 11, that cam journal portion 35a of the valve-operating cam shaft $35_2$ in the rear bank which is nearest to the timing belt is fallen under a severe lubricating condition depending upon a load received from the timing belt 38, but such cam journal portion 35a is not only lubricated by the oil supplied from the oil passage $73_2$ in the exhaust rocker shaft through the sixth oil passages $61_2$, but also lubricated by the oil supplied from the control oil passage $75_2$ through the second oil passage section $55_2$. Therefore, there is no possibility of a poor lubrication caused.

Figure 8:
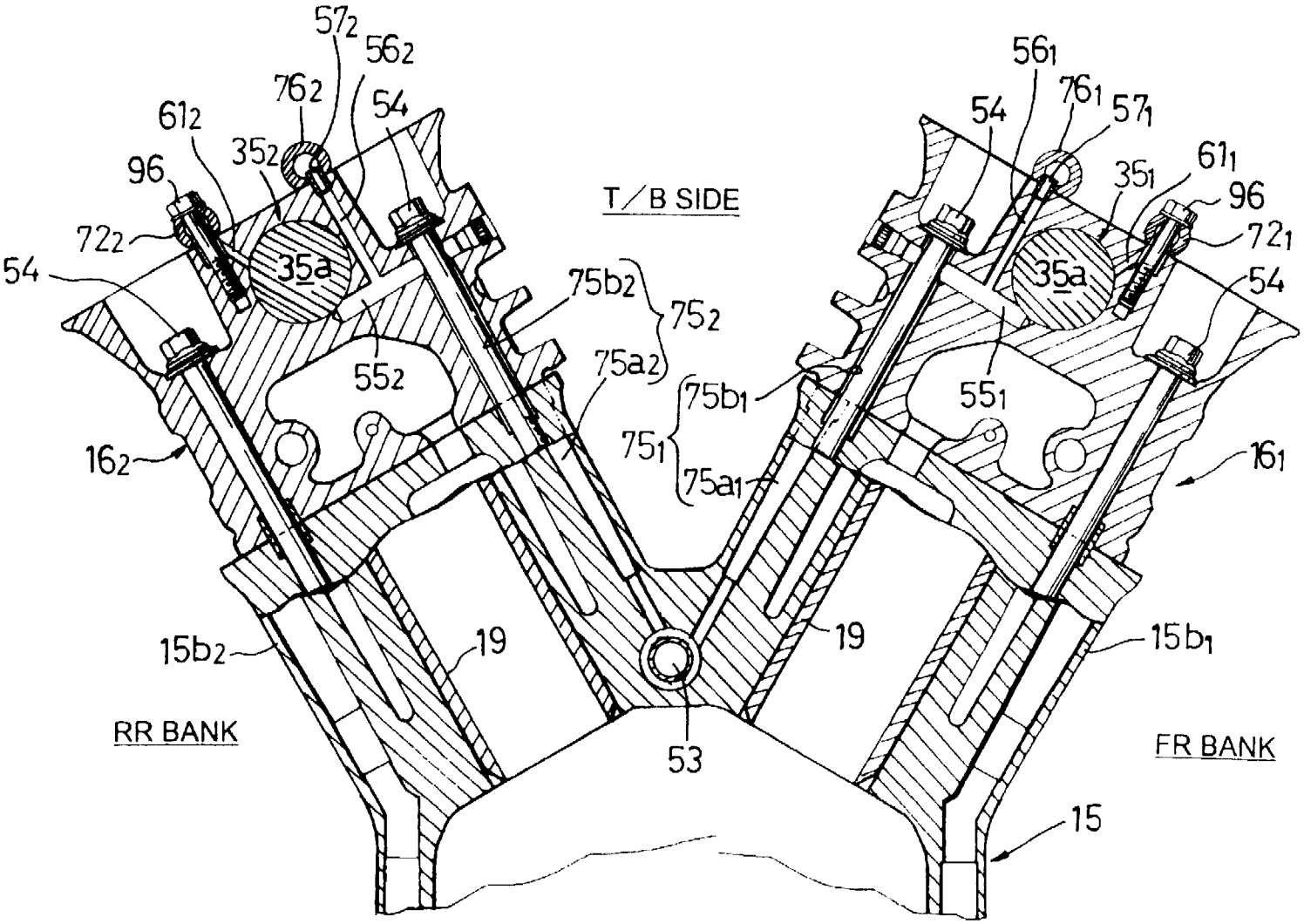
FIG. 8 is a vertical sectional view of the portion of the engine on the side of the timing belt, take along the line 8—8 in FIG. 10.
Figure 9:
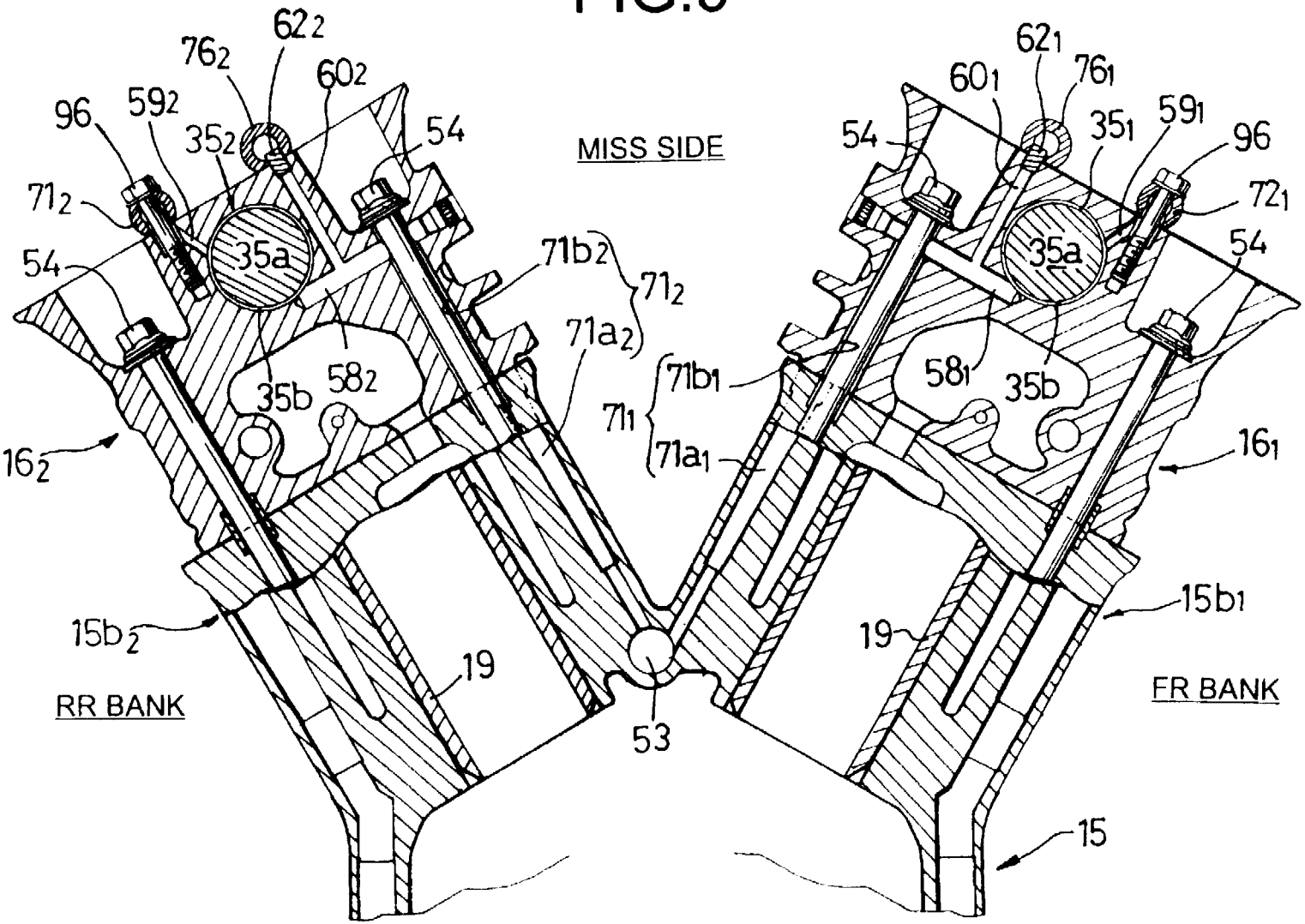
FIG. 9 is a vertical sectional view of a portion of the engine on the side of a transmission, take along the line 9—9 in FIG. 10.

As can be seen from FIGS. 8 to 10, the first oil passages $56_1$ and $56_2$ and the fifth oil passages $60_1$ and $60_2$ with the hollow knock pins $57_1$ and $57_2$ and the solid knock pins $62_1$ and $62_2$ fitted therein are formed sideways of the cam shaft bearing portions 16a and hence, the bolts 95 axially displaced from the cam bearing portions 16a cannot interfere with the oil passages $56_1$, $56_2$, $60_1$ and $60_2$. Thus, it is possible to facilitate the formation of the oil passages $56_1$, $56_2$, $60_1$ and $60_2$ and to prevent a reduction in strength of the cam bearing portions 16a.

As can be seen from FIG. 10, the cylinder head $16_1$ in the front bank and the cylinder head $16_2$ in the rear bank are formed using members having the same shape, and if the cylinder head $16_1$ in the front bank is rotated through 180 about a point O, it is superposed on the cylinder head $16_2$ in the rear bank. The solid knock pin $62_2$ is fitted in the cylinder head $16_2$ in the rear bank in correspondence to a location in which the hollow knock pin $57_1$ is fitted in the cylinder head $16_1$ in the front bank. In addition, the hollow knock pin $57_2$ is fitted in the cylinder head $16_2$ in the rear bank in correspondence to a location in which the solid knock pin $62_1$ is fitted in the cylinder head $16_1$ in the front bank. Thus, the members having the same shape can be used for the cylinder heads $16_1$ and $16_2$ in the front and rear banks.

As described above, since the oil pump P and the hydraulic pressure control valve V are disposed in the portion of the engine body E on the side of the timing belt, and the control oil is supplied from the same timing belt side to the intake rocker shafts $76_1$ and $76_2$ in the front and rear banks, the number of the hydraulic pressure control valve V may be one, but also the length of the oil passage extending from the hydraulic pressure control valve V to the intake rocker shafts $76_1$ and $76_2$ can be reduced to the minimum to avoid a reduction in pressure of the control oil.

Figure 7:
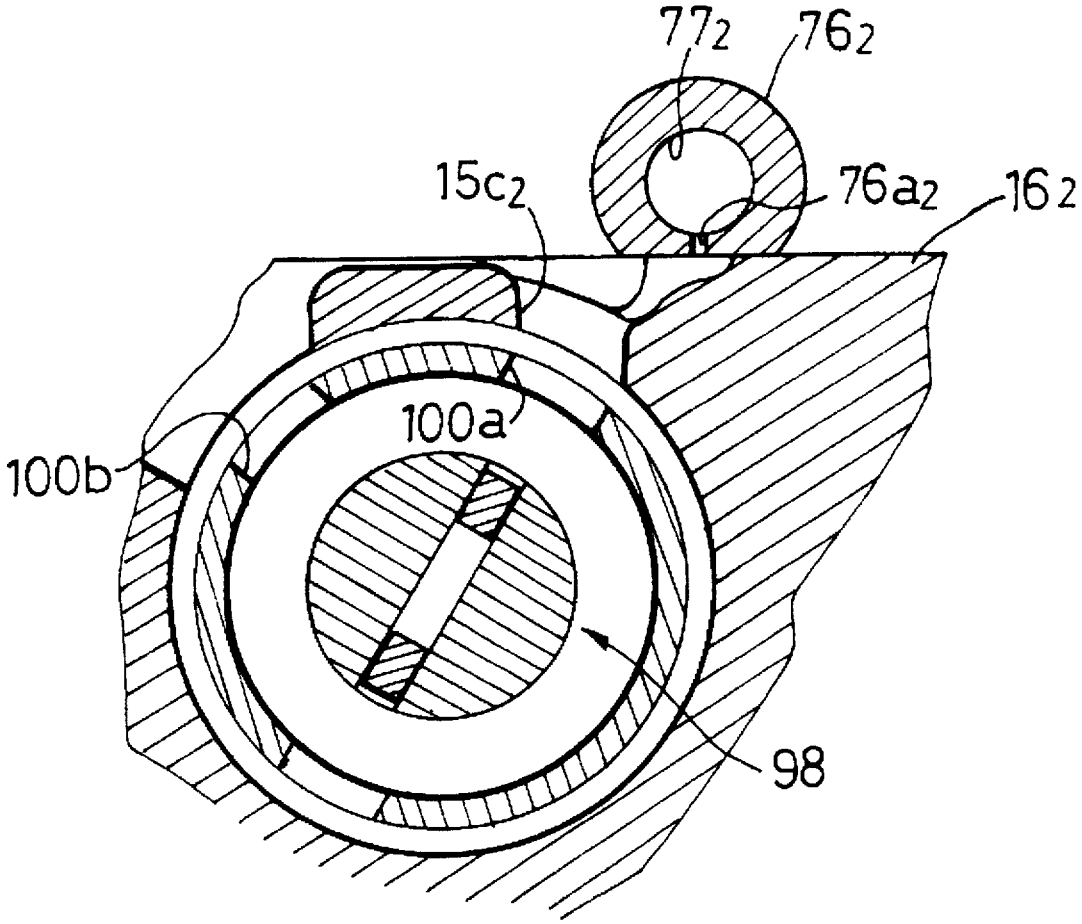
FIG. 7 is a sectional view taken along the line 7—7 in FIG. 4.

As shown in FIGS. 3, 4 and 7, a distributor $99_2$ is mounted in a portion of the rear bank on the side of the transmission and connected to the end of the valve-operating cam shaft $35_2$ through an Oldham coupling 98. A leak bore $76a_2$ opening downwards is formed in a downstream end of the oil passage $77_2$ in the intake rocker shaft, and a working oil leaked through the leak bore $76a_2$ is passed through an oil bore $15c_2$ formed in the cylinder head $16_2$ and an oil bore 100a formed in a distributor supporting member 100 to lubricate the Oldham coupling 98, and is then discharged through an oil bore 100b formed in the distributor supporting member 100. Further, the distributor supporting member 100 abuts against a flange portion at an end of the valve-operating cam shaft $35_2$ and thus, also serves to perform a thrust limitation for the valve-operating cam shaft $35_2$.

By lubricating the Oldham coupling 98 for the distributor $99_2$ by the working oil leaked from the oil passage $77_2$ in the intake rocker shaft in the above manner, the generation of a striking sound in the Oldham coupling 98 and the generation of a wearing of the Oldham coupling 98 can be prevented. Moreover, the amount of working oil leaked through the leak bore $76a_2$ is increased during a high-speed rotation and hence, the generation of a striking sound in the Oldham coupling 98 and the generation of a wearing of the Oldham coupling 98 can be further effectively prevented. Additionally, the responsiveness of switching from a high-speed rotation to a low-speed rotation with a valve timing/lift by the hydraulic actuators $A_2$ can be enhanced by leaking the working oil through the leak bore $76a_2$.

Although the embodiment of the present invention has been described in detail, it will be understood that the present invention is not limited to the above-described embodiment, and various modifications in design may be made without departing from the subject matter and scope of the present invention.

What is claimed is:

1. A valve operating system in a single overhead camshaft (SOHC) type engine comprising a hydraulic actuator which switches the states of connection between a plurality of intake rocker arms driven by a plurality of intake cams provided on a valve-operating cam shaft, thereby controlling at least one of a timing and a lift of an intake valve, wherein said valve operating system includes:

cam bearing portions integrally formed to a cylinder head for supporting cam journal portions having a diameter larger than that of a locus of rotation of cam lobes of the intake cams;

rocker shalt fixing portions integrally extended axially of the valve-operating cam shaft from said cam bearing portions for fixing the intake rocker shafts by bolts, said plurality of intake rocker arms being disposed in proximity to one another between the adjacent rocker shaft fixing portions; and positioning surfaces formed at opposed regions of said adjacent rocker shaft fixing portions for positioning said intake rocker arms in a thrust direction.

2. A valve operating system in an SOHC type engine according to claim 1, further including: a first oil passage for supplying a control oil pressure into an oil passage formed in said intake rocker shaft to operate said hydraulic actuator, said first oil passage being formed at a side of the cam bearing portions on the side of an one axial end of the valve-operating cam shaft, and at a location displaced axially of the intake rocker shaft from the bolts fixing said intake rocker shaft; a control oil passage formed in a bolt bore for coupling said cylinder head to a cylinder block; said control oil passage and said first oil passage communicating with each other by a second oil passage having a downstream end which opens into said cam journal portion supported on the cam bearing portion.

3. A valve operating system in an SOHC type engine according to claim 2, wherein a pair of the cylinder heads are provided as said cylinder head, and said pair of cylinder heads are spread into a V-shape from a cylinder block, said valve-operating cam shaft in each of the cylinder heads being provided at its axially one and other ends respectively with a control oil passage for supplying the control oil pressure into the oil passage formed in said intake rocker shaft, and with a lubricating oil passage for supplying a lubricating oil for lubricating said cam journal portions into an oil passage formed in an exhaust rocker shaft, said oil passage in said intake rocker shaft communicating with said control oil passage by a hollow knock pin on the side of said axially one end, the communication between said oil passage in said exhaust rocker shaft and said control oil passage being blocked by the cam journal portion on the side of said axially one end, the communication between said oil passage in said intake rocker shaft and said lubricating oil passage being blocked by a solid knock pin on the side of the other axial end, and said lubricating oil passage communicating with said oil passage in said exhaust rocker shaft by an annular groove formed in the cam journal portion on the side of said axially other end.

4. A valve operating system in an SOHC type engine according to claim 1, wherein a pair of the cylinder heads are provided as said cylinder head, and said pair of cylinder heads are spread into a V-shape from a cylinder block, said valve-operating cam shaft in each of the cylinder heads being provided at its axially one and other ends respectively with a control oil passage for supplying the control oil pressure into the oil passage formed in said intake rocker shaft, and with a lubricating oil passage for supplying a lubricating oil for lubricating said cam journal portions into an oil passage formed in an exhaust rocker shaft, said oil passage in said intake rocker shaft communicating with said control oil passage by a hollow knock pin on the side of said axially one end, the communication between said oil passage in said exhaust rocker shaft and said control oil passage being blocked by the cam journal portion on the side of said axially one end, the communication between said oil passage in said intake rocker shaft and said lubricating oil passage being blocked by a solid knock pin on the side of the axially other end, and said lubricating oil passage communicating with said oil passage in said exhaust rocker shaft by an annular groove formed in the cam journal portion on the side of said axially other end.

5. A valve operating system in an SOHC type engine according to claim 1, wherein said hydraulic actuator comprises: a switching pin for connecting and disconnecting a driving intake rocker arm driven by a low-speed intake cam and a free intake rocker arm driven by a high-speed intake cam; a hydraulic pressure chamber which one end of said switching pin faces, and a return spring for biasing the other end of said switching pin toward said hydraulic pressure chamber; and wherein the control oil pressure is supplied into said hydraulic pressure chamber through an oil passage formed in said intake rocker shaft.

6. A valve operating system in an SOHC type engine according to claim 1, wherein said rocker shaft fixing portions and rollers mounted on the exhaust rocker arms to abut against the exhaust cams on the valve-operating cam shaft are disposed on a plane perpendicular to an axis of said valve-operating cam shaft.

* * * * *

UNITED STATES PATENT AND TRADEMARK OFFICE

CERTIFICATE OF CORRECTION

PATENT NO. : 5,704,315

DATED : January 6, 1998

INVENTOR(S) : Koji Tsuchida, et al.

It is certified that error appears in the above-identified patent and that said Letters Patent is hereby corrected as shown below:

Column 2, line 59, change "high-speed" to --low speed--.

Column 2, line 60, change "low-speed" to --high speed--.

Column 7, line 3, change "16I" to --16i--.

Column 8, line 34, change "$71_1$" to --$75_1$--.

Column 8, line 35, change "$71_2$" to --$75_2$--.

Column 10, line 53, before "one" delete "an".

Signed and Sealed this

Twenty-seventh Day of April, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,704,315
DATED : July 23, 1998
INVENTOR(S) : K. TSUCHIDA et al.

It is certified that error appears in the above-identified patent and that said Letters Patent is hereby corrected as shown below:

IN THE DRAWINGS

Figure 7, line 2, change "GIG. 7" to --FIG. 7--.

Signed and Sealed this

Seventh Day of September, 1999

*Attest:*

Q. TODD DICKINSON

*Attesting Officer*

*Acting Commissioner of Patents and Trademarks*